US005534910A

United States Patent [19]

Sasai et al.

[11] Patent Number: 5,534,910

[45] Date of Patent: Jul. 9, 1996

[54] RECORDING APPARATUS WITH INK SHEET CONVEYANCE ADJUSTED ACCORDING TO A DETECTED INK SHEET CONVEYING STATE

[75] Inventors: Keizo Sasai; Masakatsu Iwata, both of Yokohama; Hirohisa Sawada; Fumihiko Nakamura, both of Tokyo, all of Japan

[73] Assignee: Canon Kabushiki Kaisha, Tokyo, Japan

[21] Appl. No.: 284,288

[22] Filed: Aug. 2, 1994

Related U.S. Application Data

[63] Continuation of Ser. No. 836,514, Feb. 18, 1992, abandoned.

[30] Foreign Application Priority Data

| | | | |
|---|---|---|---|
| Feb. 18, 1991 | [JP] | Japan | 3-023058 |
| Feb. 19, 1991 | [JP] | Japan | 3-024330 |
| Feb. 21, 1991 | [JP] | Japan | 3-027166 |

[51] Int. Cl.[6] ..... B41J 17/10

[52] U.S. Cl. ..... 347/217

[58] Field of Search ..... 346/70 PH; 400/232; 347/217, 215, 218

[56] References Cited

U.S. PATENT DOCUMENTS

| | | | |
|---|---|---|---|
| 5,184,151 | 2/1993 | Ono et al. | 346/76 PH |
| 5,248,994 | 9/1993 | Yoshida et al. | 346/76 PH |
| 5,266,971 | 11/1993 | Yoshida et al. | 346/76 PH |
| 5,369,422 | 11/1994 | Yoshida et al. | 346/76 PH |
| 5,371,523 | 12/1994 | Wada et al. | 346/76 PH |
| 5,384,584 | 1/1995 | Yoshida et al. | 346/76 PH |

FOREIGN PATENT DOCUMENTS

| | | | |
|---|---|---|---|
| 0360279 | 3/1990 | European Pat. Off. . | |
| 0368325 | 5/1990 | European Pat. Off. . | |
| 0411540 | 2/1991 | European Pat. Off. . | |
| 0440232 | 8/1991 | European Pat. Off. . | |
| 57-83471 | 5/1982 | Japan . | |
| 58-201686 | 11/1983 | Japan . | |
| 0141580 | 6/1986 | Japan . | |
| 62-58917 | 12/1987 | Japan . | |
| 0022082 | 1/1990 | Japan | 400/232 |

*Primary Examiner*—Huan H. Tran

*Attorney, Agent, or Firm*—Fitzpatrick, Cella, Harper & Scinto

[57] ABSTRACT

In a recording apparatus, an ink sheet and recording medium are conveyed, the ink sheet is activated to perform image recording on the recording medium, the conveying state of the ink sheet is detected, and the conveying amount of the ink sheet is adjusted in accordance with the detected information regarding the conveying state of the ink sheet. This adjustment prevents the adhesion of the recording medium and ink sheet, thereby eliminating image omissions and density irregularities in the recording. Preventing adhesion of the recording medium and ink sheet results in improved image recording quality, and also helps to reduce trouble resulting from the ink sheet or recording medium being cut off.

17 Claims, 9 Drawing Sheets

RECORDING APPARATUS WITH INK SHEET CONVEYANCE ADJUSTED ACCORDING TO A DETECTED INK SHEET CONVEYING STATE

This application is a continuation of application Ser. No. 07/836,514 filed Feb. 18, 1992, now abandoned.

BACKGROUND OF THE INVENTION

1. Field of the Invention

The present invention relates to a recording apparatus such as a thermal transfer recording apparatus for recording images on a recording medium by transferring ink contained in an ink sheet to the recording medium, for example, and a facsimile apparatus using the aforesaid apparatus.

Here, the aforesaid thermal transfer recording apparatus and other recording apparatuses include those taking a mode of an electronic typewriter, copying apparatus, printing apparatus, and the like in addition to the facsimile apparatus.

2. Related Background Art

Today, along the evolution of the information processing systems, various information processing apparatuses are being developed. Among those apparatuses, the facsimile apparatus, printer, and the like are widely used not only in office, but also at home in general.

For these facsimile and other apparatuses, the so-called thermosensitive recording systems are generally in use with a thermosensitive sheet being employed to generate color when heated in order to make them compact with ease. In recent years, however, there has been developed a facsimile apparatus according to the so-called thermal transfer recording system which uses an ink sheet. In general, this ink sheet is such that the ink is completely transferred to a recording sheet by one image recording (the so-called one time sheet). Therefore, when a letter or a line recording is over, the ink sheet must be carried for a portion corresponding to the recorded length, and it is needed to cause an unused portion of the ink sheet to be brought to the position for the next recording accurately. As a result, the consumption of the ink sheet is greatly increased so that as compared with a usual thermosensitive printer which performs recording on a thermosensitive sheet, the running cost of the thermal transfer printer tends to be high.

In order to solve a problem such as this, a thermotransfer printer has been proposed to enable a recording sheet and an ink sheet to be carried with a speed differential as disclosed in Japanese Patent Laid-Open Application No. 57-83471, Japanese Patent Laid-Open Application No. 58-201686, and Japanese Patent Publication No. 62-58917.

There is known traditionally an ink sheet which can be used for plural numbers of image recordings (the so-called multiplint sheet). When a continuous recording is performed with a recording length as L using this ink sheet, it is possible to perform the recording with the transportation length of ink sheet after the termination of each image recording or in the image recording being smaller than the recording length L, that is, (L/n:n>1). In this way, the ink sheet usage efficiency is made n times the conventional efficiency thereby to expect the reduction of the running cost of the thermotransfer printer. Hereinafter, this recording system is referred to as multiprint, and the ratio between the length of the recording sheet to be carried for one line recording and the ink sheet is referred to as n value.

When a multiprint is performed with an ink sheet such as this, it is known that the system functions more advantageously if the conveying speed of the recording sheet is faster with respect to the conveying speed of the ink sheet. To establish a relationship of the kind, it is necessary to provide an independent transportation mechanism for conveying the ink sheet and the recording sheet respectively unlike the conventional art in which only one roller is used for conveying both sheets.

However, if the black ratio (that is, a ratio of the heating elements which are caused to be exothermic by a one-line portion recording information which has been given to a line type head having heating elements) of a printing image is higher than a certain value or the standby time until the next recording operation is started is longer than a certain value, there exists a problem that the defective conveyance of the ink sheet and recording sheet and the creation of a defective image occur. Hereunder, in conjunction with FIG. 6 and FIG. 7, the description will be made of the causes of such a problem.

FIG. 6 is a view illustrating the state of an image recording that the image recording is performed by reversing the conveying directions of the recording sheet 11 and ink sheet 14 in a conventional example.

As shown in FIG. 6, the recording sheet 11 and ink sheet 14 are pinched between a platen roller 12 and a thermal head 13. The thermal head 13 is thrusted toward the platen roller 12 by a spring 21 under a predetermined pressure. Here, the recording sheet 11 is conveyed by the rotation of the platen roller 12 at a speed $V_P$ in the direction indicated by an arrow b. On the other hand, the ink sheet 14 is conveyed by the rotation of an ink sheet conveying motor 25 at a speed $V_I$ in the direction indicated by an arrow a.

Now, when the heating resistance element 132 of the thermal head 13 is energized from a power source to be heated, the portion of the ink sheet 14 which is indicated by a slanting line section 81 is heated. Here, a reference numeral 14*a* designates the base film of the ink sheet 14 and 14*b*, the ink layer of the ink sheet 14. By energizing the heating resistance element 132, the ink in the ink layer 81 thus heated is fused, and the portion thereof at 82 is transferred onto the recording sheet 11. This ink layer portion 82 to be transferred is equivalent almost to l/n of the ink layer at 81.

At this time of transfer, the recording sheet is conveyed in the direction b while the ink sheet is conveyed in the direction a. Then, a shearing force is generated against the ink at a boundary line 83 of the ink layer 14*b*. Thus, only the portion of the ink layer at 82 is transferred to the recording sheet 11.

When a one line recording is terminated in this way, the state will be as shown in FIG. 7. In other words, from the state as shown in FIG. 6, the recording sheet 11 is conveyed in the direction b for an amount of one line conveyance (1) and the ink sheet 14 is also conveyed in the direction a for an amount of (l/n) conveyance. In this state, the system is at standby for the next line recording.

However, if the ink layer and recording sheet 11 are left intact for a long time while they are in contact at the boundary line 83 where the ink layer 82 is peeled, the phenomenon that the ink layer softened by the remaining heat of the thermal head 13 has adhered to the recording sheet and become solidified when cooled (which is called adhesion) takes place. Fundamentally, the amount of carbon contained in the multiprint ink sheet is increased several times as compared with the one time ink sheet. Therefore, a resin such as EVA is added in a large quantity as a binding agent, which makes it easier for the ink sheet and recording sheet to be in a state of adhesion. As a result, such a phenomenon as this tends to occur more if the black ratio of the last recorded image is higher because in such a case the number of the heating resistance elements becomes greater to cause the ink layer to be softer. Also, if it takes longer to begin the next line recording after the termination of last one line recording, the ink layer is cooled for a longer period, thus allowing this adhesion to occur more easily.

The generation of an adhesion of the kind causes the image quality to be degraded with missing images or density irregularities, and further results in the defective conveyance of the ink sheet and recording sheet. At worst, the ink sheet and recording sheet come together and the ink sheet which is being carried in the direction b is cut off or the recording sheet and ink sheet come together and both of them are carried in the direction a to cause a serious trouble of no feeding sheet or the like.

SUMMARY OF THE INVENTION

It is an object of the present invention to provide a recording apparatus capable of obtaining clear recording images and a facsimile apparatus using the aforesaid recording apparatus.

It is another object of the present invention to provide a recording apparatus capable of preventing any defective conveyance due to the adhesion of the recording medium and ink sheet.

It is still another object of the present invention to provide a facsimile apparatus using a recording apparatus capable of preventing any defective conveyance due to the adhesion of the recording medium and ink sheet.

It is a further object of the present invention to provide a recording apparatus capable of operating the conveyance of at least either the ink sheet or the recording medium if a standby time is found to exceed a predetermined period of time when the standby time from the termination of a recording operation to the start of the next recording operation is measured, and a facsimile apparatus using the aforesaid recording apparatus.

It is still a further object of the present invention to provide a recording apparatus capable of operating the conveyance of at least either the ink sheet or the recording medium if the usage factor of the ink transferred to the recording medium by a thermal head or other recording means in the last recording operation is found to be greater than a predetermined threshold value when the ink usage factor is compared with the predetermined threshold value, and a facsimile apparatus using the aforesaid recording apparatus.

It is still a further object of the present invention to provide a recording apparatus capable of performing an operation for controlling the conveying amount of an ink sheet in accordance with the ink sheet conveyance conditions by monitoring the state of the ink sheet conveyance, and a facsimile apparatus using the aforesaid recording apparatus.

DETAILED DESCRIPTION OF THE PREFERRED EMBODIMENTS

Hereinafter, in reference to the accompanying drawings, the detailed description will be made of the preferred embodiments according to the present invention.

Description of A Facsimile Apparatus (FIG. 1–FIG. 4)

Figure 1:
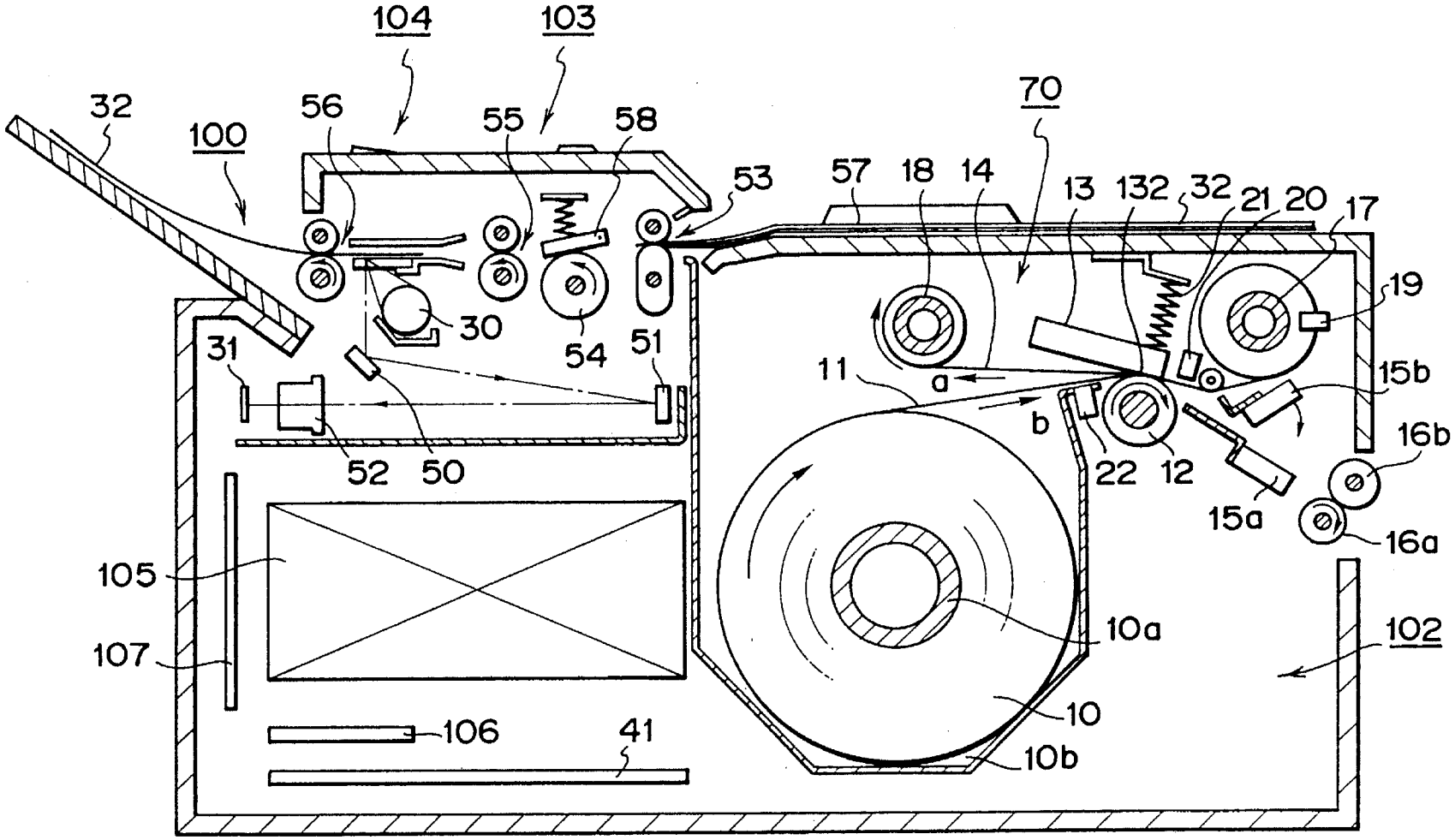
FIG. 1 is a side cross-sectional view illustrating the mechanical unit of a facsimile apparatus using a thermal transfer printer suitably embodying the present invention.
Figure 2:
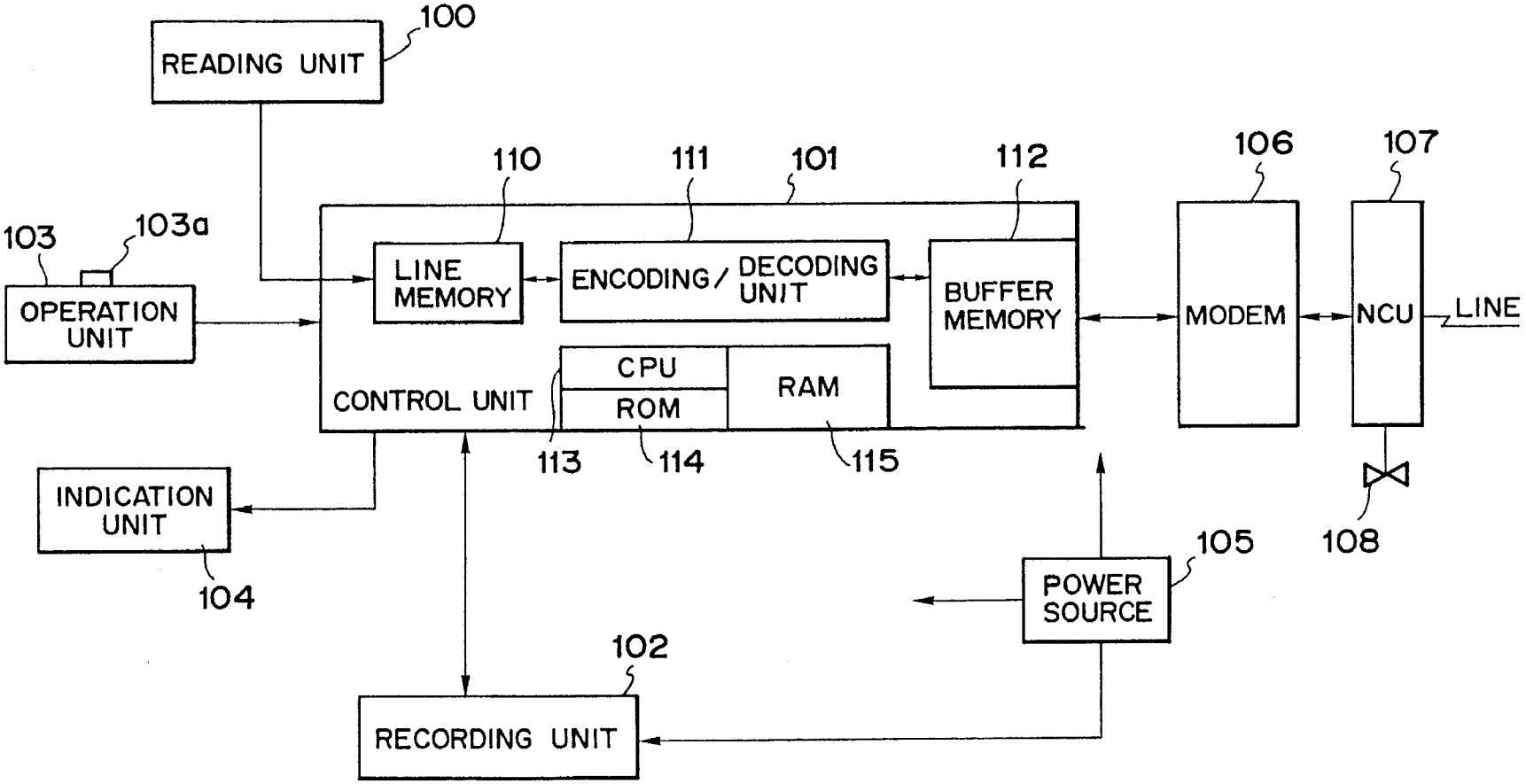
FIG. 2 is a block diagram schematically showing the structure of the facsimile apparatus shown in FIG. 1.

FIG. 1 through FIG. 4 are views illustrating a facsimile apparatus using a typical embodiment of a thermal transfer printer according to the present invention. FIG. 1 is a side cross-sectional view illustrating the facsimile apparatus. FIG. 2 is a block diagram schematically showing the structure of the facsimile apparatus.

At first, in conjunction with FIG. 2, the schematic structure of the facsimile apparatus will be described.

In FIG. 2, a reference numeral 100 designates a reading unit to read an original photoelectrically and output it to a control unit 101 as digital image signals and is provided with a original conveying motor, CCD image sensor, and others. Now, the structure of this control unit 101 will be described. A reference numeral 110 designates a line memory to store the image data for each of the image data lines, and for the transmission of the original or copying, the image data for one line portion from the reading unit 100 is stored. For receiving an image data, a one line data of the decoded image data received is stored. Then, when the stored data is output to a recording unit 102, its image formation will be performed. A reference numeral 111 designates an encoding/decoding unit to encode image information to be transmitted by MH encoding or the like and at the same time, to decode the encoded image data which have been received for converting it into the image data to be recorded, and also, 112, a buffer memory to store the encoded image data which will be transmitted or have been received. Each of these sections in the control unit 101 is controlled by a CPU 113 of a microprocessor, for example. In the control unit 101, there are provided in addition to the CPU 113, a control program for the CPU 113, a ROM 114 for storing various data, a RAM 115 for temporarily storing various data as a work area for the CPU 113, and others.

A reference numeral 102 designates a recording unit provided with a thermal line head (having plural numbers of heating elements over the recording width) to perform image recordings on a recording sheet with a thermal transfer recording method. This structure will be described later in detail in reference to FIG. 1; 103, an operation unit including indication keys for various functions to start transmission and others and telephone number input keys; 103*a*, a switch to indicate the kinds of ink sheets 14 and with the switch 103*a* being on, it indicates that a multiprint ink sheet is mounted and off, an ordinary ink sheet; 104, an indication unit to display usually the status of the various functions and devices provided for the operation unit 103; 105, a power source to supply electric power to the entire systems; 106, a modem (modulator/demodulator); 107, a network control unit (NCU); and 108, a telephone set.

Now, in reference to FIG. 1, the structure of the recording unit 102 will be described in detail. In this respect, the portions which are shared with those shown in FIG. 2 are designated by the same reference numerals.

In FIG. 1, a reference numeral 10 designates a rolled sheet of an ordinary sheet 11 wound around a core 10*a*. This rolled sheet 10 is rotatively stored in the apparatus so that the recording sheet 11 can be supplied to the thermal head unit 13 by the rotation of the platen roller 12 in the direction indicated by an arrow. Here, a reference numeral 10*b* designates the rolled sheet mounting unit in which the roller sheet 10 can be detachably mounted. Further, the platen roller 12 carries the recording sheet 11 in the direction indicated by an arrow b and at the same time, to press the ink sheet 14 and recording sheet 11 between the heating elements 132 of the thermal head 13 and the platen roller. The recording sheet 11 on which the image recording has been performed by the heating of the thermal head 13 is carried by the further rotation of the platen roller 12 in the direction toward exhausting rollers 16 (16*a* and 16*b*) to be exhausted after being cut by the engagement of cutters 15 (15*a* and 15*b*) when an image recording for a one page portion is terminated.

Figure 3:
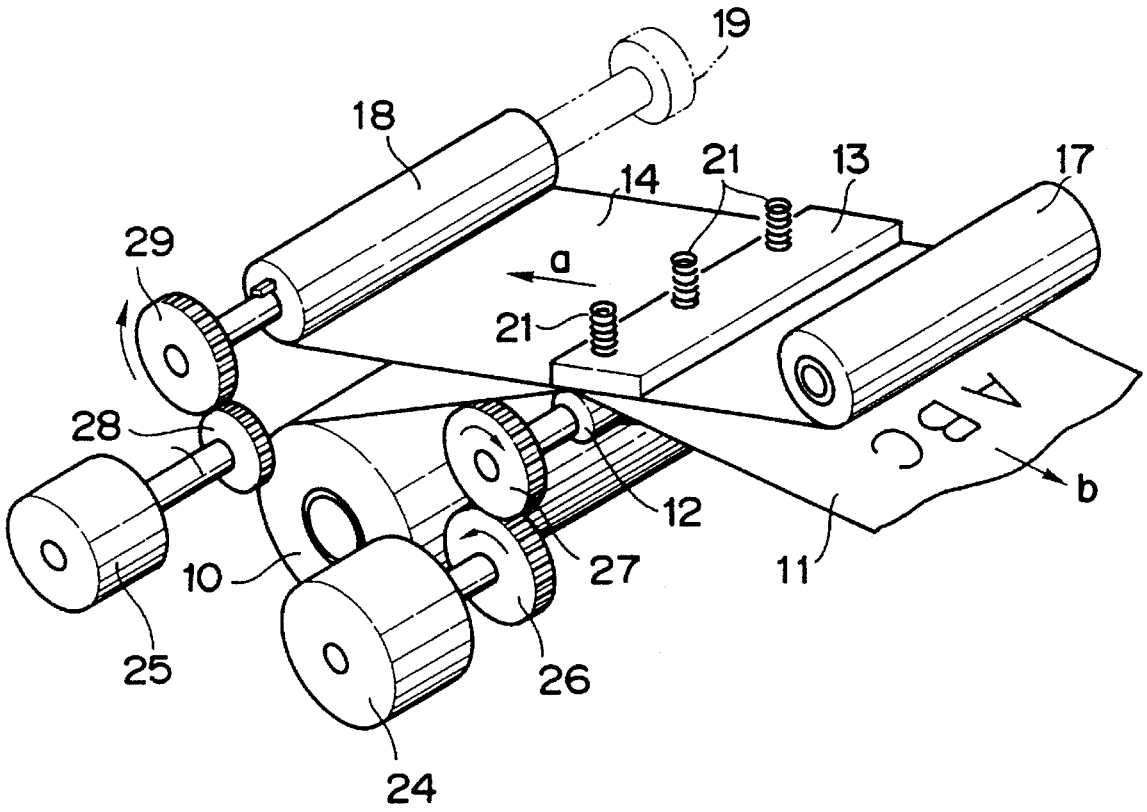
FIG. 3 is a view illustrating the structure of the feeding system for the ink sheet and recording sheet for the facsimile apparatus shown in FIG. 1.

A reference numeral 17 designates an ink sheet feed roller around which the ink sheet 14 is wound; 18, an ink sheet winding roller driven by an ink sheet conveying motor which will be described later to wind up the ink sheet 14 in the direction indicated by an arrow a. In this respect, the ink sheet feed roller 17 and ink sheet winding roller 18 are detachably mounted in an ink sheet mounting unit 70 provided in the main body of the apparatus. Further, a reference numeral 19 designates an ink sheet sensor to detect the remaining quantity of the ink sheet 14 and the conveying speed of the ink sheet 14, which may be constructed by an encoder 19' as shown in FIG. 3; also, 20, an ink sheet availability detection sensor to detect the presence of the ink sheet 14; 21, a spring to press the thermal head 13 against the aforesaid platen roller 12 through the recording sheet 11 and ink sheet 14; and also, 22, a recording sheet availability detection sensor to detect the presence of the recording sheet.

Now, the structure of the reading unit 100 will be described.

In FIG. 1, a reference numeral 30 designates a light source to irradiate an original 32, and the reflected rays of light from the original 32 are inputted into a CCD sensor 31 through an optical system (mirrors 50 and 51, and lens 52) to be converted into electric signals. The original 32 is carried by the feed rollers 53, 54, 55, and 56 driven by an original conveying motor (not shown) at a corresponding speed of the original reading. Here, a reference numeral 57 designates an original stacker, and the plural numbers of the originals 32 stacked on this stacker 57 are separated one by one by the cooperative operations of a carrier roller 54 and pressurized separation piece 58 while being guided by a slider 57*a* and carried to the reading unit 100, and then after being read, exhausted to a tray 77.

A reference numeral 41 designates a control board constituting the principal part of the control unit 101. By this control board 41, various control signals are output to each unit of the apparatus; also, 105, a power source unit; 106, a modem board unit; and 107, an NCU board unit.

Further, FIG. 3 is a view illustrating the details of the ink sheet 14 and recording sheet 11 feeding mechanism.

In FIG. 3, a recording sheet conveying motor 24 drives the platen roller 12 to rotate in order to carry the recording sheet 11 in the direction indicated by an arrow b which is opposite to the direction indicated by an arrow a. Also, an ink sheet conveying motor 25 causes the ink sheet 14 to be carried in the direction indicated by an arrow a. Here, the rotation of the recording sheet conveying motor 24 is transmitted to the platen roller 12 through the transmission gears 26 and 27 while the rotation of the ink sheet conveying motor 25 is transmitted to the winding roller 18 through the transmission gears 28 and 29.

Also, the ink sheet sensor 19 is constructed by installing an optical or electromagnetic encoder on the feed roller 17 or winding roller 18 coaxially, or by reading a photosensor while causing slits to be rotated, or by reading predetermined marks provided on the ink sheet.

Thus, by arranging the conveying directions of the recording sheet 11 and ink sheet 14 opposite to each other, the direction in which the image is sequentially recorded in the longitudinal direction of the recording sheet 11 (the direction indicated by the arrow a, that is, the direction opposite to the conveying direction of the recording sheet 11) and the conveying direction of the ink sheet 14 are matched. Here, given the conveying speed $V_P$ of the recording sheet 11 as $V_P=-n.V_I$ (where $V_I$ is the conveying speed of the ink sheet 14 and—indicates that the conveying direction of the recording sheet 11 is different from the conveying direction of the ink sheet 14), then the relative speed $V_{PI}$ of the recording sheet 11 and ink sheet 14 with respect to the thermal head 13 can be expressed as given below.

$$V_{PI}=V_P-V_I=(1+1/n)V_P$$

Hence, it is clear that this relative speed $V_{PI}$ is greater than $V_P$.

Figure 4:
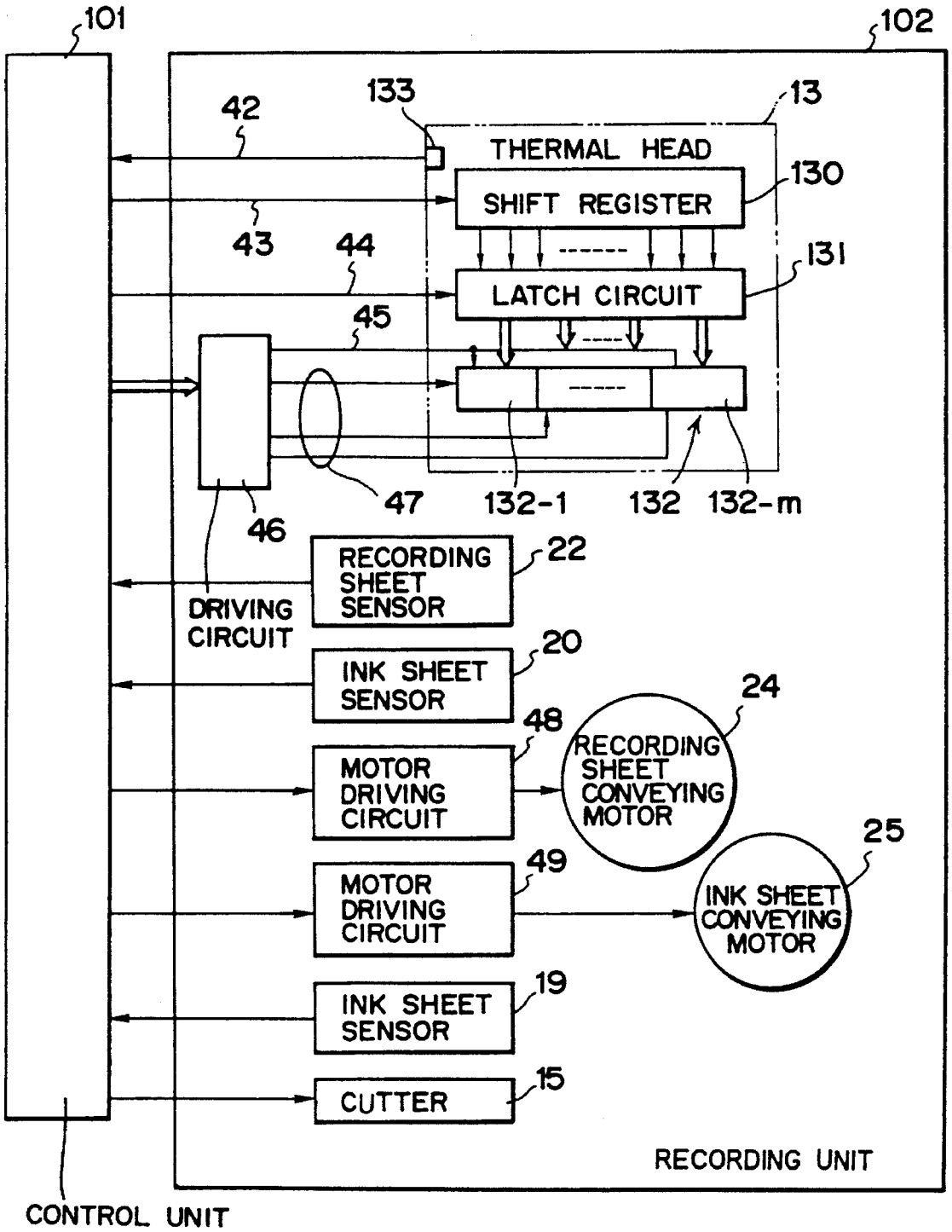
FIG. 4 is a diagram showing the electrical connections between the control unit and recording unit of the facsimile apparatus shown in FIG. 1.

FIG. 4 is a diagram showing the electrical connections for the control unit 101 and recording unit 102 of a facsimile apparatus according to the present embodiment, and the portions which are shared with those in the other figures are indicated by the same reference numerals.

The thermal head 13 is a line head. Then, this thermal head 13 is provided with a shift register 130 to input a serial recording data 43 from the control unit 101 for one line portion, a latch circuit 131 to latch the data in the shift register 130 by latch signals 44, and the heating element 132 which comprises heating resistance elements for a one-line portion. Here, the heating resistance elements 132 are divided into m blocks at 132-1 to 132-m for driving. Also, a reference numeral 133 designates a temperature sensor mounted on the thermal head 13 to detect the temperature of the thermal head 13. The output signals 42 from this temperature sensor 133 are converted by an A/D converter in the control unit 101 to be inputted into the aforesaid CPU 113. Thus, the CPU 113 detects the temperature of the thermal head 13 to modify the pulse width of the strobe signal 47 in response to the detected temperature, or change the driving voltage of the thermal head 13 or the like so as to modify the applied energy to the thermal head 13 in accordance with the characteristics of the ink sheet 14. The kinds (characteristics) of this ink sheet 14 are indicated by the aforesaid switch 103*a*. In this respect, it may be possible to discriminate the kinds, characteristics and the like by detecting the marks and others printed on the ink sheet 14. Also, it may be possible to discriminate them by detecting the mark, cutting off portion, or projection provided for the ink sheet cartridge.

A reference numeral 46 designates a driving circuit to input the driving signals for the thermal head 13 from the control unit 101 to output the strobe signals 47 for driving the thermal head 13 by each block unit. Here, it is possible for this driving circuit 46 to change the voltage to be output to the power source wiring 45 for supplying the heating elements 132 of the thermal head 13 in accordance with the instructions from the control unit 101 thereby to change the applied energy to the thermal head 13. Reference numerals 48 and 49 designate the motor driving circuits respectively for driving the recording sheet conveying motor 24 and ink sheet conveying motor 25. The recording sheet conveying motor 24 and ink sheet conveying motor 25 are a stepping motor in the present embodiment, but they are not limited thereto. A DC motor may also be employed, for example.

Description of Recording Operation for a First Embodiment

Figure 5A:
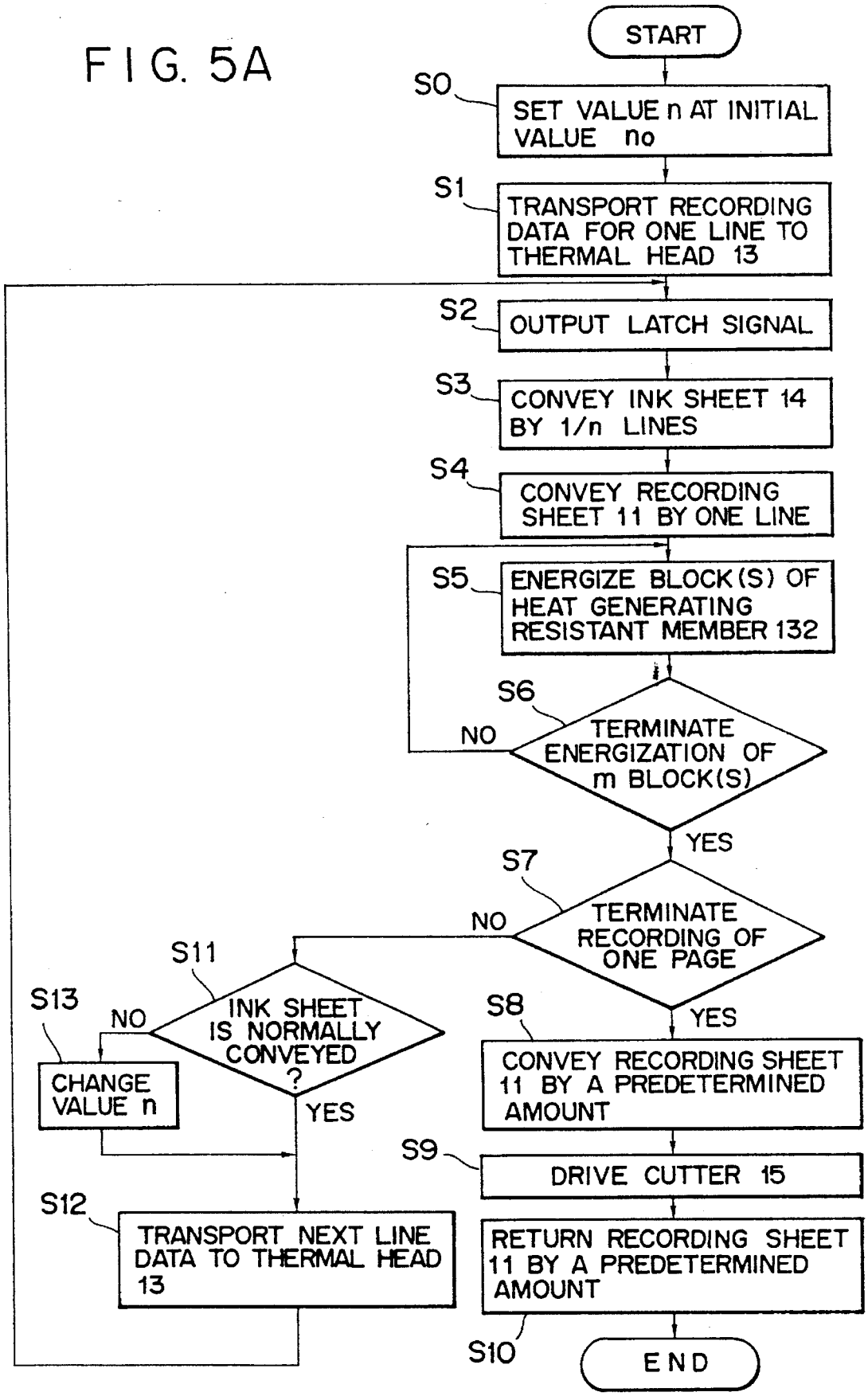
FIG. 5A is a flowchart showing the recording process for a first embodiment.

Hereinafter, in reference to a flowchart shown in FIG. 5A, the description will be made of a first embodiment of the recording process for a One page portion in a facsimile apparatus using a thermal transfer printer having the structure described in conjunction with FIG. 1 through FIG. 4. In this respect, it is assumed that the control program to execute this process is stored in the ROM 114 of the control unit 101. This process is started when a one line image data to be recorded has been stored in the line memory 110 so that the recording operation is ready for start.

At first, in step SO, an n value is assigned to the initial value $n_0$ (in the present embodiment, it is assumed that $n_0$=5). Then, in step S1, a recording data for one line portion is output to the serial register 130 in serial. Subsequently, when the transfer of the one line recording data is terminated, a latch signal 44 is output in step S2 to store the recording data for the one line portion in the latch circuit 131. Then, in step S3, the ink sheet conveying motor 25 is driven to carry the ink sheet 14 for a (l/n) of the one line portion (in the present embodiment, ⅕ line portion) in the direction indicated by the arrow a in FIG. 1. Now, in step S4, the recording sheet conveying motor 24 is driven to carry the recording sheet 11 for one line portion in the direction indicated by the arrow b. In this respect, this one line portion is a length corresponding to the length of one dot to be recorded by the thermal head 13.

Here, the ink sheet 14 and recording sheet 11 are carried almost simultaneously. Consequently, given the conveying speed of the recording sheet 11 as $V_P$, the conveying speed of the ink sheet 14, $V_I$, and the relationship between $V_P$ and $V_I$ as $V_I=V_P/n$, then the relative speed V of the recording sheet 11 and ink sheet 14 will be $V_P-V_I=(1+1/n)V_P$. In the case of the present embodiment, "5" is assigned to n. Accordingly, $V=(1+⅕)V_P$, namely, $V=6/5\ V_P$.

Now, the process proceeds to step S5 to energize each block of the heating element 132 of the thermal head 13. Then, in step S6, whether the entire m numbered blocks are energized or not is examined. When the one line image recording is terminated after the entire blocks of the heating element 132 have been energized, the process proceeds to step S7 to examine whether the image recording for one page portion is terminated.

In the step S7, when the termination of the image recording for one page portion is confirmed, the process proceeds to step S8 to carry the recording sheet 11 for a predetermined amount in the direction toward the sheet exhaust rollers 16*a* and 16*b*. Then, in step S9, the cutters 15*a* and 15*b* are driven to be engaged to cut the recorded recording sheet 11 for one page unit. Thus, in step S10, the recording sheet 11 is retracted for a portion corresponding to a distance between the thermal head 13 and cutters 15 to terminate the image recording process for the one page portion.

If, on the contrary, the image recording is found in the step S7 yet to be terminated for the one page portion, the process proceeds to step S11 to make preparation for the next line recording, in which the output from the ink sheet sensor 19 is read by the control unit 101 to determine whether or not the ink sheet 14 is normally carried in the last one line recording or not (that is, whether a $l/n_0$ line portion has been conveyed or not is examined).

Here, if the conveyance of the ink sheet 14 is found to be normal, the process proceeds to a step S12 to transfer the next line data to the thermal head 13. Then, the process will return to the step S2 to execute the recording operation for the next line.

On the other hand, if the adhesion of the ink sheet 14 has occurred and the conveyance is found to be abnormal in step S11, then the process proceeds to step S13 to execute the processing required in step S12 after having modified the n value (the initial value being n=5 in the present embodiment, it is modified to be n=3, for example).

When a modification of the n value of the kind is executed, the conveying amount of the ink sheet will be ⅓ line portion for the second line and on whereas it is ⅕ line portion for the first line, and the conveying amount of the ink sheet 14 to be fed for one line recording operation will be increased. At the same time, the relative speed (V) will also be $V=(1+⅓)V_P=4/3\ V_P$. Accordingly, $V=6/5\ V_P$ is replaced with $V=4/3\ V_P$ and the relative speed (V) for the second line becomes faster than the first line.

In the multiprint, the faster the relative speed (V) of the ink sheet and recording sheet is, the more difficult it is for the adhesion to occur. Therefore, in the present embodiment, if any adhesion takes place in the first line, then the n value for the second line and on is made smaller so that the conveying amount of the ink sheet 14 is increased in order to make the relative speed (V) faster to prevent the creation of the adhesion. Further, when the recording operation is continued for the next line and on, the feeding condition of the ink sheet is observed each time, and the n value can be modified to be a correct value accordingly. Also, if the n value is made smaller as in the case of the present embodiment, the consumption of the ink sheet 14 is increased eventually. Therefore, from the viewpoint of saving the ink sheet, the n value should desirably be reset to the initial value $n_0$ if it is determined that with the black ratio of the current recording data, any adhesion can hardly occur and that there is no possibility that any defective feeding of the ink sheet 14 can easily take place. To this end, it is more preferable to arrange an additional control so that the n value is again modified to a large value if there is no abnormal feeding takes place in a predetermined length of the ink sheet used after the n value has been made smaller.

In this respect, the modification of the n value can be made either by a method of stepping changes or by a method of stepless changes. Also, the changes in the conveying amount of the ink sheet 14 accompanying the n value modification can be performed simply by changing the revolving amount of the ink sheet conveying motor 24.

According to experiments, when the n value is 6 or more for a recording with a 50% black ratio, the adhesion takes place to result in a defective feeding with the energizing pulse for the thermal head being 0.6 (msec), but by reducing then value to 5, this situation is corrected.

Also, in the present embodiment, the description has been made of the control to make the n value smaller when any defective conveyance takes place, but there may be some cases where a normal conveyance is effectuated even if the n value is modified to be a larger value.

If, for example, an n value is as small as 2, that is, the case where the conveying speed of the ink sheet is faster than the present embodiment for a recording, then the supply of ink becomes great and a large amount of ink is fused at a time, resulting in the adhesion of the ink sheet 14 and recording sheet 11. In such a case, it becomes possible to perform a normal conveyance of the ink sheet 14 and recording sheet 11 by making the n value large ($3 \leqq n \leqq 5$, for example).

Here, the n value at which the aforesaid conveyance of the ink sheet 14 is determined is not only defined by the amount of the revolution of the recording sheet conveying motor 24 and of the ink sheet conveying motor 25, but is also modified by changing the speed reduction ratio between the transmission gears 26 and 27 of the platen roller 12 driving system and the transmission gears 28 and 29 of the winding roller 18 driving system. Also, when both the recording sheet conveying motor 24 and the ink sheet conveying motor 25 are arranged by stepping motors, this value can be defined by selecting the motors so that their minimal step angles differ from each other. In this way, the relative speed of the recording sheet 11 and ink sheet 14 can be $(1+1/n)V_P$.

Description of Recording Operation for a Second Embodiment

Figure 5B:
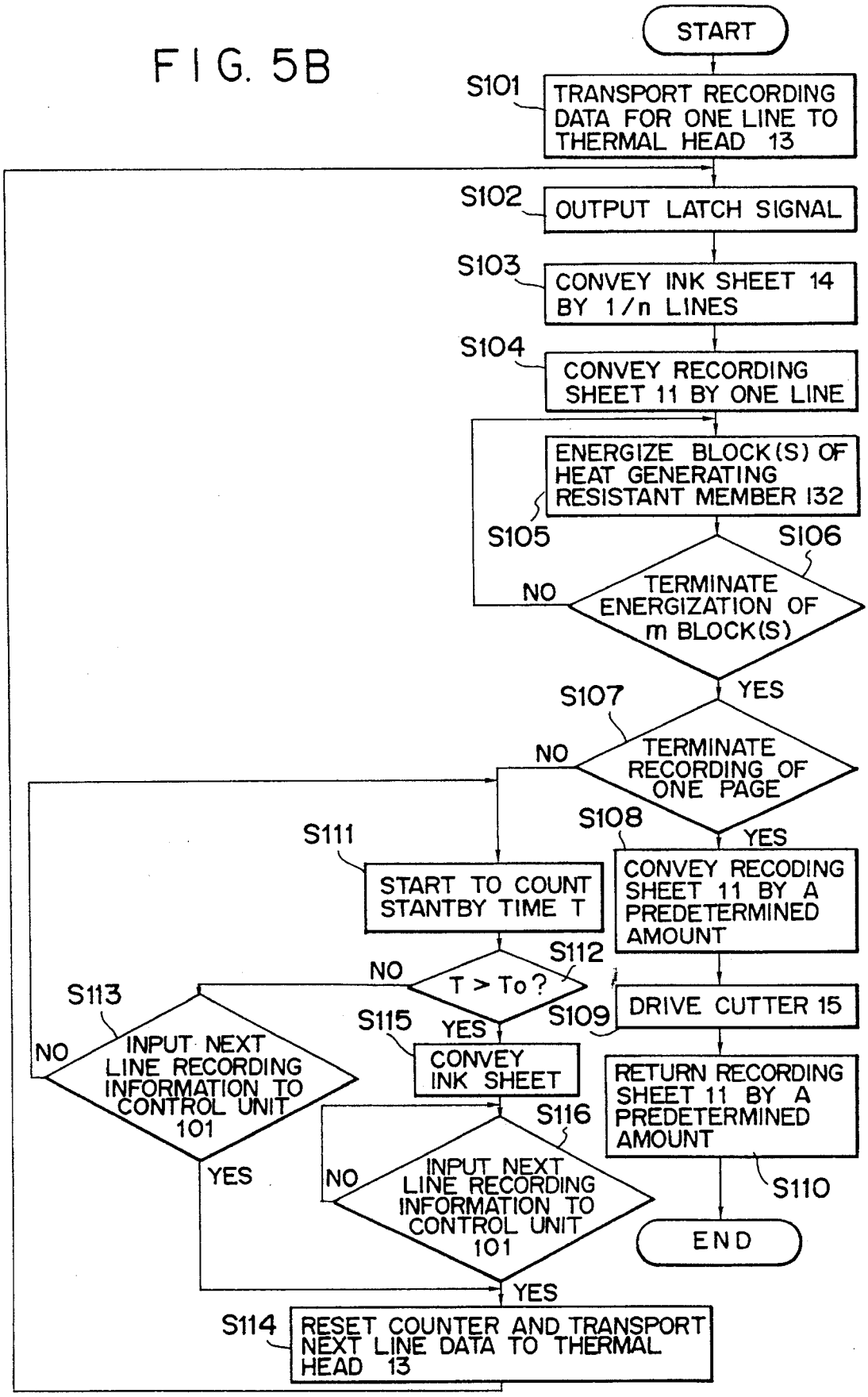
FIG. 5B is a flowchart showing the recording process for a second embodiment.

Hereinafter, in reference to a flowchart shown in FIG. 5B, the description will be made of a second embodiment of the recording process for a one page portion in a facsimile apparatus using a thermal transfer printer having the structure described in conjunction with FIG. 1 through FIG. 4.

For step S101 through step S107, the step S1 through step S7 of the aforesaid first embodiment are quoted because the processes in these steps are the same.

In the step S107, if it is determined that an image recording for one-page portion has not been terminated, the process proceeds to step S111 to start counting the time to elapse from the termination of the last line recording (hereinafter referred to a standby time (T)). Subsequently in step S112, the standby time (T) is compared with a predetermined time ($T_0$), and if $T \leqq T_0$, then the process proceeds to step S113. If $T > T_0$, the process proceeds to step S115.

Now, in step S113, the system is prepared for the next line recording information which will be transmitted to the control unit 101 through the modem 106. Here, if no recording information for the next line is transmitted, then the process will return to the step S111 to keep on counting the standby time (T).

In contrast, if a recording information is received, the process proceeds to step S114 to reset the standby time (T) counting and at the same time, to execute the required recording operation by transferring the next line data to the thermal head 13. Then, the process will return to the Step 102 to continue the same recording operation. In this case, the standby time (T) is not so long as to create any adhesion, it should be possible to keep on recording without conveying the ink sheet and recording sheet during the standby period.

On the other hand, if $T > T_0$, then the process proceeds to the step S115 to execute the required processing to prevent adhesion by feeding the ink sheet 14 or recording sheet 11 on the assumption that an ink sheet adhesion may take place easily. In the present embodiment, the recording sheet 11 is not fed and remains at its current position while the ink sheet 14 is conveyed in the direction a for a predetermined length (l). At this juncture, the thermal head 13 is not driven. Thus, the boundary face 83 is transferred in the direction a and a new ink layer is in contact with the recording sheet 11 at the recording position for the next line. Therefore, even if the standby time becomes longer, they are not caused to create any adhesion.

After this processing, the process proceeds to step S116 to enable the system to be in a standby state for the next line recording information. Here, when the next line recording information is transmitted to the control unit 101, the process proceeds to the step S114 to execute the recording operation after transferring the next line data to the thermal head 13. Then, the process will return to the step S102 to continue the same recording operation.

In this respect, it is preferable to make the conveying amount of the ink sheet 14 in the step S115 the same as the conveying amount (1) of the recording sheet 11 for a one line portion, but it may be possible to set it for an appropriate amount. Also, if a mechanism to transport the ink sheet 14 in the direction b is arranged so as to convey the ink sheet 14 in the direction a firstly for a predetermined amount for the prevention of any adhesion in the step S115 and then to convey it in the direction b for the same amount. Thus, it becomes possible to eliminate any waste of the ink sheet 14. Or while keeping the ink sheet 14 at a current position, the recording sheet 11 is transferred in the direction b for a predetermined amount and then retracted in the direction a for the same amount, thus making it possible to obtained the same effect.

Here, for the value $T_0$, any value can be selected appropriately for avoiding the adhesion of the ink sheet 14 and recording sheet 11. However, according to experiments, at $T_0 \geqq 50$ (msec) there tends to occur the adhesion. It is therefore desirable to make it $T_0 < 50$ (msec). It is further desirable to make it $T_0 < 20$ (msec). Nevertheless, the frequency of the adhesion occurrence depends on the ambient conditions or the black ratio (R) of the recorded image on the last line, and the like. Therefore, it is desirable to define some other value of $T_0$ as its optimal value.

In this respect, the n value at which the aforesaid ink sheet 14 conveyance is determined can be defined not only by the revolving amount of the recording sheet conveying motor 24 and the ink sheet conveying motor 25, but can also be modified by changing the speed reducing ratio of the transmission gears 26 and 27 of the platen roller 12 driving system and the transmission gears 28 and 29 of the winding roller 18 driving system. Also, when both of the recording sheet conveying motor 24 and ink sheet conveying motor 25 are arranged with stepping motors, this value can be defined by selecting those motors so that their minimal step angles differ from each other. Thus, it is possible to make the relative speed of the recording sheet 11 and ink sheet 14 $(1+1/n)V_P$.

Also, as shown in the step S103 and step S104, it is desirable to actuate the conveyance driving of the ink sheet conveying motor 25 earlier than the conveyance driving of the recording sheet conveying motor 24. This is because there is a time lag before the conveyance of the ink sheet 14 is actually started even when the ink sheet conveying motor 25 is driven due to the characteristics of the motor, driving power transmission systems, and others.

Also, in the present embodiment, the resetting of the standby time (T) counting is performed when a recording information for the next line is inputted into the control unit 101, but it may be possible to reset it when the ink sheet conveyance for the next line recording is instructed by the control unit 101.

Description of Recording Operation for a Third Embodiment

Figure 5C:
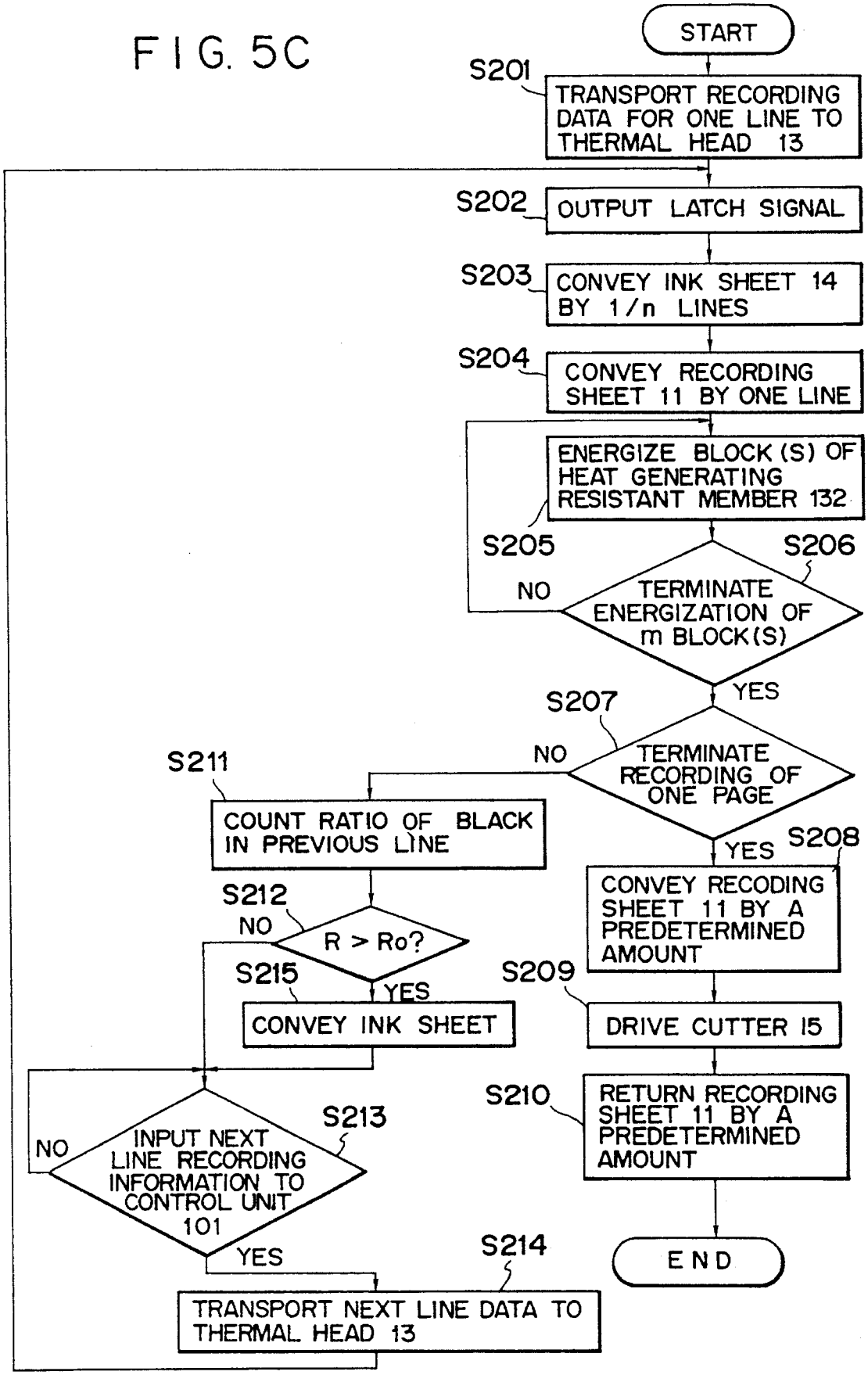
FIG. 5C is a flowchart showing the recording process for a third embodiment.
Figure 6:
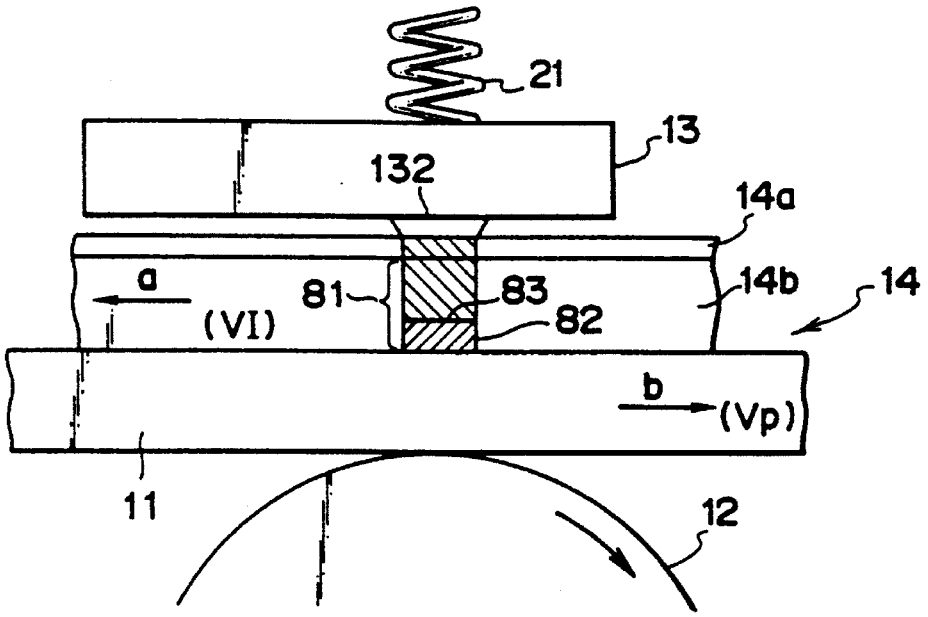
FIG. 6 is a view schematically illustrating the state of the recording sheet and ink sheet in a conventional recording.
Figure 7:
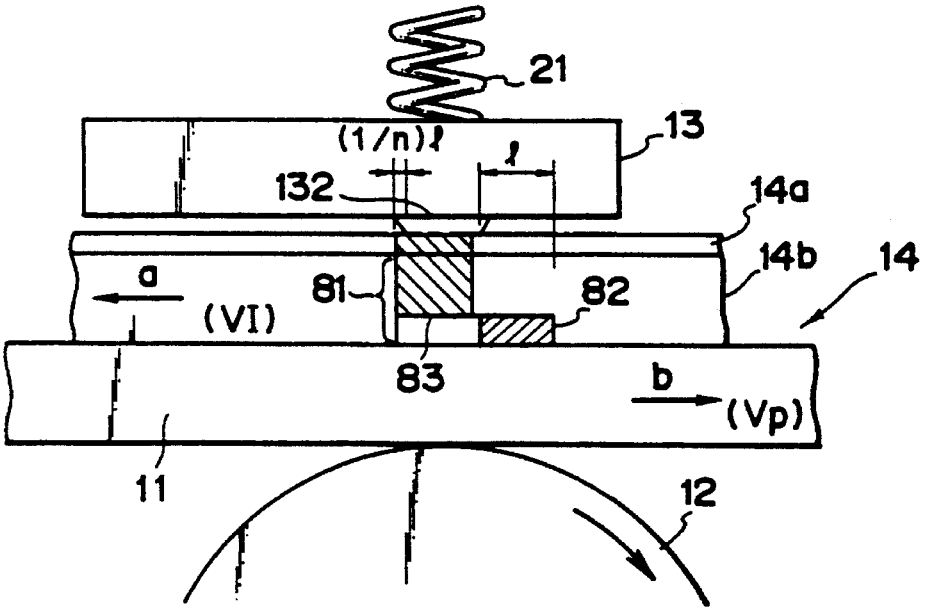
FIG. 7 is a view schematically illustrating the state of the recording sheet and ink sheet in a conventional recording.

Hereinafter, in reference to a flowchart shown in FIG. 5C, the description will be made of a third embodiment of the recording process for a one page portion in a facsimile apparatus using a thermal transfer printer having the structure described in conjunction with FIG. 1 through FIG. 4.

For step S201 through step S207, the step S1 through step S7 of the aforesaid first embodiment are quoted because the processes in these steps are the same.

In the step S207, if it is determined that an image recording for one page portion has not been terminated, then the process proceeds to step S211 for the preparation of the next line recording and in the control unit 101, the black ratio (R) of the last line recording is calculated. Here, the black ration (R) is defined to be a percentage (%) of the heating resistance elements energized for the black printing against the number of the heating resistance elements 132 provided for the thermal head 13. For example, a thermal head 13 to perform image recording for the width of B-4 size is provided with 2,048 pieces of heating resistance elements 132, and assuming that those heating resistance elements which have been energized to perform the black printing are 1,024 of the total number thereof, the value of the black ratio (R) in this case will be T=1,024/2,048=50%.

Subsequently, in step S212, the control unit 101 further compares the black ratio (R) with a predetermined black ratio ($R_0$) which is provided in advance. Here, if the result of the comparison is $R \leqq R_0$, then the process proceeds to step S213. If $R > R_0$, the process proceeds to step S215.

Now, in step S213, the system is prepared for the next line recording information which will be transmitted to the control unit 101 through the modem 106. When the next line recording information is received, the process proceeds to step S214, and subsequent to the transfer of the next line data to the thermal head 13, the process will return to step S202 to keep on the same recording operation. In this case, the value of the black ratio (R) is not so great as to create any adhesion, the recording should be continued without feeding the ink sheet and recording sheet during the standby period.

On the other hand, if $R > R_0$, the process proceeds to step S215 to execute a processing for the prevention of the adhesion by feeding either the ink sheet 14 or the recording sheet 11 on the assumption that the ink sheet adhesion may easily be created. In the present embodiment, while the recording sheet 11 is kept at the current position, only the ink sheet 14 is conveyed in the direction a for a predetermined length (l). At this juncture, the thermal head 13 is not driven. Thus, the boundary face 83 is transferred in the direction a, and no ink layer which has been heated by the energized heating elements to be softened is in contact with the recording sheet 11 at the next line recording position. Hence there is no possibility to cause any adhesion to occur because a new ink layer is in contact instead.

After a processing such as this, the process proceeds to step S213 to execute the aforesaid processings (that is, steps S213 and S214).

In this respect, it is preferable to make the conveying amount of the ink sheet 14 executed in the step S215 the same as the conveying amount of the recording sheet 11 for one line portion (1), but it may be possible to set it for an appropriate amount. It may also be possible to control in order to eliminate any waste of the ink sheet 14 by arranging a mechanism to convey the ink sheet 14 in the direction b so that in the step S215, the ink sheet 14 is firstly conveyed in the direction a for a predetermined length to prevent the adhesion and then it is transferred in the direction b for the same amount after a passage of a predetermined time. In this case, the boundary face 83 will be in contact with the recording sheet again, but since a predetermined time has elapsed, the ink layer is already cooled and no adhesion will result. Also, while keeping the position of the ink sheet 14, the recording sheet 11 is conveyed in the direction b for a predetermined amount and then retracted in the direction a for the same amount, thus making it possible to obtain the same effect.

Here, an appropriate value at which no adhesion of the ink sheet 14 and recording sheet 11 can occur should be selected for a threshold value of the black ratio ($R_0$), but on condition of the energizing pulse for the thermal head being 0.6 (msec) there tends to occur an adhesion if the threshold value is $R_0 \geqq 50\%$ according to experiments. Therefore, it should preferably be $R_0 < 50\%$, or further preferably be $R_0 < 30\%$. Nevertheless, the frequency of the adhesion occurrence depends on the ambient conditions or the standby time (T). It is therefore desirable to define some other value for an optimal threshold value in the respect.

For example, it is preferable to perform the aforesaid ink sheet conveyance for the prevention of the adhesion within an appropriate time subsequent to the termination of the last line recording. According to experiments, it is found that if the state is left intact for more than 50 (msec) after the termination of the last line recording, the frequency of the adhesion occurrence becomes high. On the other hand, if the ink sheet is conveyed at the same time of the termination of the last line recording, then the ink is smeared to result in stains. It is therefore preferable to execute the aforesaid ink sheet conveyance at least within a range of approximately 10 to 50 (msec).

In this respect, the n value at which the aforesaid conveyance of the ink sheet 14 is determined can be defined not only by the revolving amount of the recording sheet conveying motor 24 and the ink sheet conveying motor 25, but can also be modified by changing the speed reducing ratio of the transmission gears 26 and 27 of the platen roller 12 driving system and the transmission gears 28 and 29 of the winding roller 18 driving system. Also, when both of the recording sheet conveying motor 24 and ink sheet conveying motor 25 are arranged with stepping motors, this value can be defined by selecting those motors so that their minimal step angles differ from each other. Thus, it is possible to make the relative speed of the recording sheet 11 and ink sheet 14 $(1+1/n)V_P$.

Also, as shown in the step S203 and step S204, it is desirable to actuate the conveyance driving of the ink sheet conveying motor 25 earilier than the conveyance driving of the recording sheet conveying motor 24. This is because there is a time lag before the conveyance of the ink sheet 14 is actually started even when the ink sheet conveying motor 25 is driven due to the characteristics of the motor, driving power transmission systems, and others.

Description of Recording Operation for a Fourth Embodiment

As described above in detail, the black ratio (R) in the last line recording and standby time (T) are the causes of the adhesion of the ink sheet 14 and recording sheet 11. However, these two are interrelated with each other.

Here, experiments are made to examine the presence of the adhesion by varying the values of the black ratio (R) and standby time (T). The findings of such findings are shown in Table 1.

TABLE 1

| Relationship between R and T with respect to the adhesion [where n = 5 and the energizing time for the thermal head = 0.6 msec] | | | |
|---|---|---|---|
| | T msec | | |
| R % | 0 ≦ T < 20 | 20 ≦ T < 50 | 50 ≦ T |
| 0 ≦ R < 30 | ○ | ○ | Δ |
| 30 ≦ R < 50 | ○ | Δ | Δ |
| 50 ≦ R | Δ | Δ | X |

In the Table 1, a mark ○ indicates no occurrence of the adhesion; Δ, some cases of adhesion occurrence when non-standard recording sheet other than the one usually recommended for use for a recording apparatus of the kind is not used; and X, easy occurrence of the adhesion even when the standard sheet is used as a recording sheet.

As clear from this Table, it is preferable to adopt $T_0$<50 msec when the observation is made individually for the $T_0$. Further, it is clear that it is more preferable to adopt $T_0$<20 msec.

Likewise, when the observation is made individually for $R_0$, it is preferable to adopt $R_0$< 50% and more preferable to adopt $R_0$<30%.

However, in consideration of the running cost for the recording apparatus, it is preferable to avoid any empty conveyance (conveyance in a state of no recording) of the ink sheet 14 or recording sheet 11 as much as possible.

Therefore, in a case of 50 msec $\leqq T_0$ or 50% $\leqq R_0$, the ink sheet conveyance is performed to execute the aforesaid processing to prevent the adhesion.

Hereunder, using FIG. 5C, the recording operation for such a purpose will be described. In other words, a standby time (T) from the termination of the last line recording to the start of the next line recording is calculated in the control unit 101 and is added to the calculation in the step S212. Then, if the relationship is 50% $\leqq R_0$ or 50 msec $\leqq T_0$, then the process proceeds to the step S215 to execute the ink sheet conveyance for the prevention of the adhesion before performing the recording.

Figure 8:
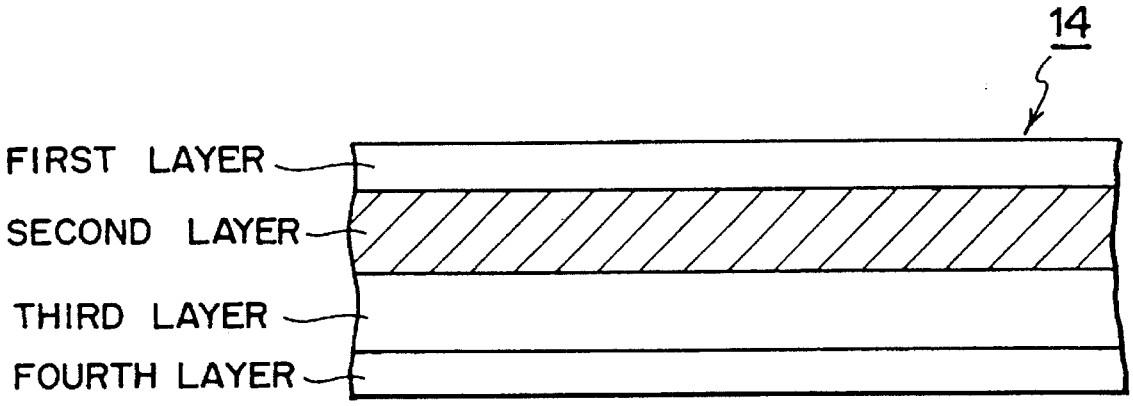
FIG. 8 is a cross-sectional view illustrating an ink sheet used for an embodiment according to the present invention.

FIG. 8 is a cross-sectional view of ink sheet used for a multiprint according to the present embodiment. Here the ink sheet is constructed with four layers.

First, a second layer is the base film which is a member to support the ink sheet 14. In the case of a multiprint, the heat energy is applied repeatedly to a same location. Therefore, it is advantageous to use a high heat resistive-aromatic polyamide film or condenser sheet, but the conventional polyester film is also applicable. From the viewpoint of its role as a medium the thickness of the film should be as thin as possible to obtain a better printing quality. However, from the viewpoint of the required strength, it is desirable to make its thickness three to eight μm.

A third layer is the ink layer containing an amount of ink capable of being transferred onto a recording paper (recording sheet) repeatedly for n times. The components thereof are resin such as EVA as adhesive, carbon black and nigrosine dye for coloring agent, and carnauba wax, paraffin wax, and the like for binding agent. These elements are appropriately mixed as principle components to enable the layer to withstand a repeated application in a same location for n times. It is desirable to coat this layer in an amount of 4–8 g/m$^2$. However, such an amount can arbitrarily be selected because the sensitivity and density may differ depending on the amount of the coating.

A fourth layer is the top coating layer to prevent the ink in the third layer from being transferred by pressure to the ink sheet in a location where no printing is performed. This layer is formed with transparent wax or the like. Thus, the fourth layer which is transparent is the only portion to be transferred by pressure, and this prevents the recording sheet from being stained. A first layer is the heat resistive coating layer to protect the second layer which is the base film from the heat of the thermal head 13. This is particularly suited for the multiprint for which the heat energy for n lines is often applied to a same portion (when black information is continuously given), but its application is arbitrarily selective. Also, this is effectively applicable to a base film having a comparatively low heat resistivity such as polyester film.

Also, the composition of ink sheet 14 is not limited to the present embodiment. For example, the ink sheet can also be formed with a base layer and a porous ink retaining layer containing ink which is provided at one side of the base layer, or having a fine porous netting structure provided on the base film to contain ink. Also, as the materials for the base film, for example, film or sheet made of polyamide, polyethylene, polyester, poly vinyl chloride, triacetilene cellulose, nylon, and the like can be used. Further, although the heat resistive coating is not necessarily required, its material may also be silicon resin, epoxy resin, fluorine resin, ethorocellulose, or the like.

Also, as an example of ink sheet containing a thermally sublimating ink, there is an ink sheet in which a coloring layer containing spacer particles and dye composed with guanamine resin and fluorine resin is formed on a substrate made of polyethylene terephtharate, aromatic polyamide film, or the like.

Also, the heating method is not limited to a thermal head method using the aforesaid thermal head. The heating method using a current-carrying or laser transfer may also be employed, for example.

Also, in the present embodiment, the description has been made of an example in which the thermal line head is used, but the application is not limited thereto. For example, using an ink ribbon having the same material as the ink sheet described in the present embodiment, a multiprint can be implemented even in the case of recording by the serial head. In other words, the ink ribbon mounted on a carriage is wound up for a l/n portion of the recording length in the traveling direction of the carriage thereby to implement a multiprint.

Also, the recording medium is not limited to recording sheet. If only a material is capable of accepting ink transfer, cloth, plastic sheet or the like can be used as a recording medium. Also, the ink sheet is not limited to the rolled type as shown in the present embodiment. It can be, for example, an ink sheet contained in a housing which can detachably be installed in the main body of recording apparatus, i.e., the so-called ink sheet cassette type whereby such a housing containing the ink sheet is detachably mounted as it is in the main body of the recording apparatus.

Also, in each of the aforesaid embodiments, the description has been made of a facsimile apparatus. The present invention, however, is not limited to such an application only. It can also be applicable when the thermal transfer printer is applied to a word processor, typewriter, copying machine, or the like.

As described above, it is possible to prevent the adhesion of the recording medium and ink sheet according to the present invention. Therefore, there is no possibility of any omission of images and density irregularities thereby to improve the image quality efficiently. Also, the prevention of the adhesion of the recording medium and ink sheet can contribute to the reduction of a trouble such as a cut off of the ink sheet or recording medium.

Also, according to the present invention, it is possible to provide a recording apparatus capable of obtaining clear recording images and a facsimile apparatus using the aforesaid recording apparatus.

We claim:

1. A thermal transfer recording apparatus for transferring ink of an ink sheet to a recording medium to record on the recording medium, said apparatus comprising:

ink sheet conveying means for conveying the ink sheet;

recording medium conveying means for conveying the recording medium;

a thermal head for thermally transferring ink of the ink sheet to the recording medium;

detecting means for detecting a conveyance condition of the ink sheet; and changing means for changing a conveyance amount of the ink sheet in accordance with a detection by said detecting means that a conveyance amount of the ink sheet during a previous recording is not a predetermined amount.

2. A thermal transfer recording apparatus according to claim 1, wherein a length of said ink sheet to be conveyed for recording is shorter than a length of said recording medium to be conveyed for recording.

3. A thermal transfer recording apparatus according to claim 1, wherein said ink sheet and said recording medium are conveyed in opposite directions in a recording area where recording is performed by said thermal head.

4. A thermal transfer recording apparatus according to claim 1, wherein said thermal head is a line type thermal head for performing recording over a lateral length of said recording medium.

5. A thermal transfer recording apparatus according to claim 1, wherein said ink sheet is provided with an inking width corresponding to a width of said recording medium.

6. A thermal transfer recording apparatus according to claim 1, wherein said detecting means has an encoder mounted on a winding shaft for winding said ink sheet used for recording.

7. A thermal transfer recording apparatus according to claim 1, wherein said changing means adjusts the conveying amount of said ink sheet to be increased in response to information from said detecting means regarding a defective conveyance of said ink sheet.

8. A thermal transfer recording apparatus according to claim 1, wherein said changing means adjusts the conveying amount of said ink sheet to be decreased in response to information from said detecting means regarding a defective conveyance of said ink sheet.

9. A thermal transfer recording apparatus according to claim 1, wherein said apparatus is a facsimile apparatus having means for receiving signals through external communication lines for performing recording in accordance with the signals received.

10. An apparatus according to claim 1, wherein said changing means controls and drives said ink sheet conveying means so as to change the conveyance amount of the ink sheet.

11. An apparatus according to claim 1, wherein said changing means controls and drives said ink sheet conveying means to convey the ink sheet more than the predetermined amount in accordance with a detection by said detecting means that the conveyance amount of the ink sheet during the previous recording is less than the predetermined amount.

12. A method for removing an adhesion between an ink sheet and a recording medium in a thermal transfer recording apparatus for transferring ink of the ink sheet to the recording medium to record on the recording medium, said method comprising the steps of:

conveying the ink sheet and the recording medium by an ink sheet conveying mechanism and a recording medium conveying mechanism;

recording by transferring ink of the conveying ink sheet to the conveying recording medium using a thermal head;

discriminating whether the ink sheet is conveyed normally at said recording step; and removing the adhesion of the ink sheet by driving the ink sheet conveying mechanism so as to convey the ink sheet more than a conveyance amount of the ink sheet at said conveying step when at said discriminating step it is discriminated that the ink sheet is not conveyed normally.

13. A method according to claim 12, wherein a length of said ink sheet conveyed in said conveying step for recording is shorter than a length of said recording medium conveyed in said conveying step for recording.

14. A method according to claim 12, wherein in said conveying step said ink sheet and said recording medium are conveyed in opposite directions in a recording area where said recording step is performed.

15. A method according to claim 12, wherein said thermal head is a line type thermal head for performing recording over a lateral length of said recording medium.

16. A method according to claim 12, wherein said ink sheet is provided with an inking width corresponding to a width of said recording medium.

17. A method according to claim 12, wherein said discriminating step is performed by a detecting means having an encoder mounted on a winding shaft for winding said ink sheet used for recording.

* * * * *

UNITED STATES PATENT AND TRADEMARK OFFICE

CERTIFICATE OF CORRECTION

PATENT NO. : 5,534,910

DATED : July 9, 1996

INVENTOR(S) : Keizo Sasai et al.

It is certified that error appears in the above-identified patent and that said Letters Patent is hereby corrected as shown below:

FIGURE 5B

Box S108, "RECODING" should read --RECORDING--.
Box S111, "STANTBY" should read --STANDBY--.

COLUMN 1

Line 53, "multiplint" should read --multiprint--.

COLUMN 2

Line 3, "the" should read --this--.
Line 5, "respectively" should read --respectively,--.

COLUMN 3

Line 9, "the kind" should read --this kind--.

COLUMN 4

Line 40, "a" should read --an--.

COLUMN 5

Line 7, "usually" should read --visually--.

COLUMN 6

Line 35, "and—indicates" should read --and the negative sign indicates --.

UNITED STATES PATENT AND TRADEMARK OFFICE

CERTIFICATE OF CORRECTION

PATENT NO. : 5,534,910

DATED : July 9, 1996

INVENTOR(S) : Keizo Sasai et al.

It is certified that error appears in the above-identified patent and that said Letters Patent is hereby corrected as shown below:

COLUMN 7

Line 28, "One" should read --one--.
Line 36, "step SO," should read --step S0,--.
Line 56, "$V_I=V_P/n$," should read --$V_I=-V_P/n$,--.
Line 57, "$V_P-V_I=(1+1/n)V_P$." should read --$V=V_P-V_I=(1+1/n)V_P$.--

COLUMN 9

Line 4, "then" should read --the n--.
Line 46, "a" should read --as--.
Line 61, "102" should read --S102--.

COLUMN 11

Line 20, "ration (R)" should read --ratio (R)--.

COLUMN 12

Line 52, "earilier" should read --earlier--.
Line 66, "findings" (second occurrence) should read --experiments--.

COLUMN 13

Line 20, "As" should read --As is--.
Line 62, "principle" should read --principal--.

UNITED STATES PATENT AND TRADEMARK OFFICE

CERTIFICATE OF CORRECTION

PATENT NO. : 5,534,910

DATED : July 9, 1996

INVENTOR(S) : Keizo Sasai et al.

It is certified that error appears in the above-identified patent and that said Letters Patent is hereby corrected as shown below:

COLUMN 14

Line 22, "triacitilene" should read --triacetylene--.
Line 26, ethorocellulose" should read --ethylcellulose--.
Line 31, "terephtharate," should read --terephthalate,--.

COLUMN 15

Line 2, "cut off" should read --cut-off--.

Signed and Sealed this

Seventeenth Day of December, 1996

*Attest:*

*Attesting Officer*

BRUCE LEHMAN

*Commissioner of Patents and Trademarks*